US006130020A

United States Patent [19]

Wada et al.

[11] Patent Number: 6,130,020

[45] Date of Patent: Oct. 10, 2000

[54] DEVELOPING AGENT

[75] Inventors: Minoru Wada, Kawanishi; Junji Machida; Osamu Ebisu, both of Toyonaka, all of Japan

[73] Assignee: Minolta Co., Ltd., Osaka, Japan

[21] Appl. No.: 09/208,005

[22] Filed: Dec. 9, 1998

[30] Foreign Application Priority Data

Dec. 12, 1997 [JP] Japan ..... 9-342643
Dec. 12, 1997 [JP] Japan ..... 9-342645

[51] Int. Cl.[7] ..... G03G 9/097

[52] U.S. Cl. ..... 430/110; 430/111

[58] Field of Search ..... 430/110, 111

[56] References Cited

U.S. PATENT DOCUMENTS 4,803,144 2/1989 Hosoi ..... 430/106.6
5,202,213 4/1993 Nakahara et al. ..... 430/111
5,332,639 7/1994 Nakamura et al. ..... 430/110
5,397,667 3/1995 Law et al. ..... 430/110
5,858,597 1/1999 Mizoh et al. ..... 430/110

FOREIGN PATENT DOCUMENTS 53-22447 7/1978 Japan .

*Primary Examiner*—Roland Martin
*Attorney, Agent, or Firm*—Burns, Doane, Swecker & Mathis, LLP

[57] ABSTRACT

The present invention relates to a developing agent comprising:

toner particles containing at least a binder resin and a coloring agent; and metallic oxide fine particles represented by a composition formula $Si_xA_yO_{4x+yz)/2}$ (wherein the character A represents a metallic element, the character Z represents a valence number of element A, and x/y is 1–25), the metallic oxide fine particles being hydrophobically treated if desired.

19 Claims, No Drawings

DEVELOPING AGENT

This application is based on application(s) Nos. Hei 09-342643 and Hei 09-342645 filed in Japan, the contents of which are hereby incorporated by reference.

BACKGROUND OF THE INVENTION

1. Field of the Invention

The present invention relates to a developing agent for use in copying machines, printers, etc. and, more particularly, a developing agent wherein the quantity of charge is adjusted by metallic oxide fine particles so that the developing agent can exhibit stable charging characteristics even when continuously used for a long time.

2. Description of the Prior Art

It has been a conventional technique that the quantity of charge in an electro-photographic developing agent is adjusted by a charge control agent, such as nigrosine or quaternary ammonium salt. With the technical progress of the art of after-treatment agent, however, it has become possible to adjust the quantity of charge by an after-treatment agent. Methods available for this purpose include a method in which two or more different kinds of after-treatment agents are added so that charge adjustment is made according to the ratio of such addition, and another method in which charge adjustment is made by adding an after-treatment agent having its surface treated with a coupling agent. For example, Japanese Patent Publication No. 53-22447 describes a positive charge-controllable developing agent containing aminosilane-treated metallic oxide particles as a component material thereof.

With a method using such after-treatment agent for surface modification, however, it is not possible to achieve surface stability and to maintain the initial charging characteristics of the agent for long due to changes and deterioration in properties of the treated surface in the course of long continuous use. Another problem is that even when two or more different kinds of after-treatment agents are used, it is difficult to maintain the initial charging characteristics because of the fact that one kind of after-treatment agent is selectively disengaged alone from the toner particle surface with the result that the electrostatic charge goes out of balance. When the charging stability is low in this way, fogging will occur on a reproduced image.

SUMMARY OF THE INVENTION

It is an object of the invention to provide a developing agent which is charge-quantity-adjustable by metallic oxide fine particles and which can exhibit stable charging characteristic even when continuously used for a long period of time.

It is another object of the invention to provide a developing agent which can be electrically charged stably even when stored under high temperature/high humidity conditions or under low temperature/low humidity conditions, especially when stored under high temperature/high humidity conditions, and which can thus exhibit high environmental resistance.

In order to accomplish these objects, the present invention provides a developing agent comprising:

toner particles containing at least a binder resin and a coloring agent; and metallic oxide fine particles represented by a composition formula $Si_xA_yO_{(4x+yz)/2}$ (wherein the character A represents a metallic element, the character Z represents a valence number of element A, and x/y is 1–25).

DETAILED DESCRIPTION OF THE INVENTION

The present invention relates to a developing agent comprising:

toner particles containing at least a binder resin and a coloring agent; and metallic oxide fine particles represented by a composition formula $Si_xA_yO_{(4x+yz)/2}$ (wherein the character A represents a metallic element, the character Z represents a valence number of element A, and x/y is 1–25).

In the present invention, the composition of metallic oxide fine particles to be added to toner particles are varied to adjust the quantity of charge of the metallic oxide fine particles themselves. Only the surface of the metallic oxide fine particles is not modified. The present invention is based on the finding that the addition of such the above metallic oxide fine particles effects to improve the charging stability of the electrophotographic developing agent and to retain its initial charging characteristic when the developing agent is continuously used for a long period of time.

The present invention will now be explained with respect to the case wherein metallic oxide fine particles are externally added to toner particles which comprise at least a binder resin and a coloring agent. It should be understood, however, that the present invention is not limited to the above embodiments, and that the metallic oxide fine particles may be added to the toner particles in the process of producing toner particles so that they are contained in the toner particles (internal addition). It is noted in the present invention that it is preferable that metallic oxide fine particles is externally added to the toner particles since the presence of metallic oxide fine particles in the vicinity of the surface of toner particles provides for greater effect of charge adjustment. The expression "external addition" used herein means that such fine particles are added to and mixed with toner particles which have been once obtained.

In the present invention, metallic oxide fine particles to be added are represented by the composition formula $Si_xA_yO_{(4x+yz)/2}$. In the formula, the character A denotes a metallic element, preferably aluminum, boron, titanium, zinc, or vanadium, more preferably aluminum, boron, or titanium. The character z denotes the number of valences of the metallic element A used. In the formula, x/y is 1–25, preferably 1–20, more preferably 1–10. If x/y is less than 1 or more than 25, addition of such metallic oxide fine particles will not provide for any improvement in charging stability of the resultant electrophotographic developing agent.

For metallic oxide fine particles having an x/y value of 1–25, those represented by the composition formulas shown in Table 1 below may be enumerated for example. In Table 1, composition formulas are shown with respect to different cases, that is, where A in the formula is aluminum (Al); where A is boron (B); and where A is titanium (Ti). Composition ratios (wt %) are shown with respect to $Al_2O_3$, $B_2O_3$, or $TiO_2$ in respective composition formulas.

TABLE 1

| $Si_xA_yO_{(4x+y)/2}$ | | | | | |
|---|---|---|---|---|---|
| When A is Al | | When A is B | | When A is Ti | |
| Composition Formula | $Al_2O_3$ Ratio (wt %) | Composition Formula | $B_2O_3$ Ratio (wt %) | Composition Formula | $TiO_2$ Ratio (wt %) |
| $Si_2Al_2O_7$ | 45.90 | $Si_2B_2O_7$ | 36.70 | $SiTiO_4$ | 57.10 |
| $Si_3Al_2O_9$ | 36.10 | $Si_3B_2O_9$ | 27.90 | $Si_2TiO_6$ | 39.90 |
| $Si_4Al_2O_{11}$ | 29.80 | $Si_4B_2O_{11}$ | 22.50 | $Si_3TiO_8$ | 30.70 |
| $Si_5Al_2O_{13}$ | 25.30 | $Si_5B_2O_{13}$ | 18.80 | $Si_4TiO_{10}$ | 24.90 |
| $Si_{15}Al_2O_{33}$ | 10.20 | $Si_{15}B_2O_{33}$ | 7.20 | $Si_5TiO_{12}$ | 21.00 |
| $Si_{20}Al_2O_{43}$ | 7.80 | $Si_{20}B_2O_{43}$ | 5.50 | $Si_{15}TiO_{32}$ | 8.10 |
| $Si_{25}Al_2O_{53}$ | 6.40 | $Si_{25}B_2O_{53}$ | 4.40 | $Si_{20}TiO_{42}$ | 6.20 |
| $Si_{30}Al_2O_{63}$ | 5.40 | | | $Si_{25}TiO_{52}$ | 5.00 |
| $Si_{35}Al_2O_{73}$ | 4.60 | | | | |

Metallic oxide fine particles usable in the present invention have a work function of 3.5 to 5.0 eV, preferably 4.0 to 5.0 eV, more preferably 4.0 to 4.7 eV. The term "work function" used herein means a minimal energy necessary for taking one electron from a crystal surface to a location just outside the surface. In inorgano-metallic fine particles to be used in the present invention, a work function value has a close relation with the charging properties of the toner. By controlling the value of work function it becomes possible to control the charging characteristics of inorgano-metallic fine particles more easily. It also becomes possible to adjust the charging characteristics of the toner added with such fine particles. If the work function is less than 3.5 eV or more than 5.0 eV, the addition of metallic oxide fine particles may not result in improvement in the charging stability of the electrophotographic developing agent.

In the present invention, from the view points of the chargeability and fluidity of the toner, it is desirable that a specific surface area of metallic oxide fine particles is 10–400 $m^2/g$, preferably 40–200 $m^2$.

The method of producing metallic oxide fine particles usable for the purpose of the present invention is not particularly limited when such particles having above mentioned formula can be produced. For example, any production method utilizing the known vapor phase process may be mentioned as such. The vapor phase process is a process for producing metallic oxide particles by oxidizing a metallic halide in vapor under high temperature conditions, and makes it possible to produce metallic oxide fine particles of above mentioned compositions by using halogen compounds of metals corresponding to "A" in the above composition formulas in combination with silicon halides in different ratios.

Metallic oxide fine particles produced in this way usually contain impurities contained in the metallic halogen compounds. In the present invention, however, the metallic oxide particles may contain impurities within an acceptable range in which they are not detrimental to the effects of the invention, preferably not more than 10 wt %.

In the present invention, metallic oxide fine particles having above mentioned composition formula may be hydrophobically treated. It is desirable that the degree of hydrophobicity is not less than 30%, preferably not less than 40%. By using metallic oxide fine particles which are treated so as to have a hydrophobic degree of not less than 30%, it is possible to enhance the environmental resistance of the toner. The problem of fogging in copied images which may occur when the toner is stored under high temperature/high humidity conditions, or low temperature/low humidity conditions, especially when the toner is stored under high temperature/high humidity conditions, is dissoluble.

Hydrophobicizing treatment of metallic oxide fine particles is carried out by adding a dilute solution of a hydrophobicizing agent to a mixture of the metallic oxide fine particles with a solvent under stirring, then disintegrating the resulting mixture thoroughly after being heated and dried. Alternatively, the fine particles are immersed in a solution of a hydrophobicizing agent dissolved in an organic solvent, then dried and disintegrated.

For the hydrophobicizing agent various agents known as such may be used including, for example, silane coupling agent, amino silane coupling agent, titanate coupling agent, silicone oil, and silicone varnish. However, since it is necessary that the difference between the work function of the metallic oxide fine particles before the hydrophobicizing treatment and that after such treatment must be kept at a level of not more than 0.5, the coupling agent should be suitably selected in the consideration of the work function of the metallic oxide fine particles.

It is desirable that the difference between the work function of the metallic oxide fine particles before the hydrophobicizing treatment and that after the treatment is not more than 0.5 eV, preferably not more than 0.3 eV, more preferably not more than 0.2 eV. If the difference exceeds 0.5 eV, the effect of the hydrophobicizing treatment will be lost in the course of repetitive copying operation, whereupon the initial charge quantity can no longer be maintained.

Such metallic oxide fine particles are added in a proportion from 0.01 to 5 parts by weight, preferably from 0.1 to 3 parts by weight, relative to 100 parts by weight of toner particles. If the quantity of addition is less than 0.01 part by weight, the metallic oxide fine particles have no effect of charge quantity adjustment. If the addition exceeds 5 parts by weight, the migration of such particles to the carrier will increase, resulting in endurance degradation of the toner.

In the present invention, by externally adding inorganic fine particles having a mean primary particle size of not more than 20 nm, preferably from 6 to 18 nm in combination with the metallic oxide fine particles of aforementioned composition, it is possible to achieve further improved charging characteristics and fluidity. For such inorganic fine particles, various kinds of inorganic fine particulate materials known as fluidizing agents in the prior art may be enumerated including silica, alumina, boron oxide, titanium oxide, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, and zinc stearate. Among these materials, silica is preferred. From the standpoint of environmental stability, it is desirable that such inorganic fine particles are used after being hydrophobically treated with silane coupling agent, titanium coupling agent, higher fatty acid, silicone oil, or the like. Preferably, a quantity of addition of such inorganic fine particles is such that the total quantity of the inorganic particles and metallic oxide fine particles is within a range from 0.01 to 5 parts by weight, preferably from 0.1 to 3 parts by weight, relative to 100 parts by weight of toner particles.

In the present invention, the metallic oxide fine particles are externally added to the toner particles. Toner particles to be used in the invention may be produced by any known method, such as kneading/grinding method, suspension polymerization method, emulsion polymerization method, emulsion dispersion method, or capsulation method, using a binder resin, coloring agents, and other desired additives, which will be described hereinafter. Of these methods, the kneading/grinding method is preferably employed from the standpoints of production cost and production stability.

In the kneading/grinding method, for example, toner particles are produced through the steps of mixing toner particle components, such as binder resin and coloring agents, in a mixer, such as Henschel mixer, melting and kneading the resulting mixture, pulverizing the kneaded mixture after the mixture is cooled, and classifying the pulverized particles. From the viewpoint of high precision image-reproduction, it is desirable that toner particles in the present invention are prepared so as to have a volume mean particle size of 4 to 10 μm, preferably 6 to 9 μm.

For the binder resin usable in the present invention, polyester, polystyrene, styrene-acrylic resins, methacrylic resins, and derivatives thereof and mixtures of these resins may be exemplified.

For the coloring agents, the following pigments and dyes may be enumerated.

Black pigments usable in the invention are carbon black, copper oxide, manganese dioxide, aniline black, activated carbon, ferrite, and magnetite.

Yellow pigments usable in the invention are yellow lead, zinc yellow, cadmium yellow, yellow oxide, mineral first yellow, nickel titanium yellow, Naples yellow, Naphthol Yellow-S, Hansa Yellow-G, Hansa Yellow-10G, benzidine yellow G, benzidine yellow GR, quinoline yellow lake, permanent yellow NCG, and tartrazine lake.

Red pigments usable in the invention are red chrome yellow pigment, molybdate orange, permanent orange GTR, pyrazolone orange, vulcan orange, indanthrene brilliant orange RK, benzidine orange G, indanthrene brilliant orange GK, iron oxide red, cadmium red, red lead, permanent red 4R, lithol red, pyrazolone red, Watchung red, lake red C, lake red D, brilliant carmine 6B, eosine lake, rhodamine lake B, alizarin lake, brilliant carmine 3B, permanent orange GTR, vulcan first orange GG, permanent red FRH, and permanent carmine FB.

Blue pigments usable in the invention are iron blue, cobalt blue, alkali blue lake, victoria blue lake, and phthalocyanine blue.

A quantity of addition of such coloring agents is not particularly limited, but is usually from 1 to 20 parts by weight, preferably from 3 to 15 parts by weight relative to 100 parts by weight of the binder resin.

In addition to aforesaid binder resin and coloring agents, other additives to be added if desired may include a magnetic material, a charge control agent, and an offset-preventing agent. Specifically, for the magnetic material, magnetite, r-hematite, and various kinds of ferrite may be used.

The charge control agent is not particularly restrictive. As positive charge-control agents the following may be enumerated, for example: nigrosine dyes, triphenylmethane compounds, and quaternary ammonium salt compounds. As negative charge-control agents the following may be enumerated, for example: metallic salicylate complex, metal-containing azo dyes, calix arene compounds, and boron-containing compounds. A quantity of addition of such an agent is within the range between 0.1 and 10 parts by weight relative to 100 parts by weight of the binder resin.

The offset preventive agent is not particularly restrictive either. For example, polyethylene wax, oxidized-type polyethylene wax, polypropylene wax, oxidized-type polypropylene wax, carnauba wax, sasol wax, rice wax, candelilla wax, jojoba oil wax, and beeswax can be used as such. A quantity of addition of such a wax is 0.5 to 5 parts by weight, preferably 1 to 3 parts by weight, relative to 100 parts by weight of the binder resin.

The developing agent of the present invention can be obtained by adding above mentioned metallic oxide fine particles to toner particles comprising above mentioned toner particle components, and mixing the resultant mixture by a mixer, such as Henschel mixer. In case that the metallic oxide fine particles are internally contained in the toner particles, that is, they are loaded in the course of production of toner particle, the metallic oxide fine particles are added at the first mixing stage in the same way as in the case of other toner particle components.

The developing agent of the present invention is usable as a mono-component developing agent in which no carrier is used and also as a two-component developing agent which is to be used together with a carrier. For the carrier to be used together with the toner of the invention, any known carrier may be used. For example, the following carriers are all usable as such: a carrier comprising magnetic particles, such as iron powder or ferrite; a coated carrier having a surface coated with a coating material such as resin; and a binder type carrier having magnetic fine powder dispersed in a binder resin. Preferably, such a carrier has a volume mean particle size of 15 to 100 μm, more preferably 20 to 80 μm.

The developing agent, obtained in the above mentioned way, is not liable to degrade its charging characteristics in the course of long-term continuous use, and can maintain its initial charging characteristics. This makes it possible to give a satisfactory copy images free of fog on the ground even after repeatedly copied.

The following examples and experimental data are given to further illustrate the present invention.

EXAMPLES

Toner Particle Preparation

One hundred parts by weight of styrene-acrylic resin (Tm=118° C., Tg=68° C.), 8 parts by weight of carbon black (Mogul L: made by Cabot K.K.), and 3 parts by weight of low molecular weight polypropylene ("Viscol 550P: made by Sanyo Kasei K. K.) were thoroughly mixed in a Henschell mixer. The mixture was then kneaded in a twin-screw extruder, and the kneaded mixture was then cooled. Thereafter, the kneaded mixture was pulverized in a jet mill and the resulting particles were air-classified to give toner particles having a volume mean particle size of 9 μm.

Experimental Data 1

Metallic oxide fine particles having a niominal composition weight ratio of $SiO_2/Al_2O_3$=70/30, obtained from Kojyundo Kagaku Kenkyusho K. K. (a high-purity chemical institute), were subjected to an elemental analysis through a fluorescent X-ray analysis. The composition ratio was identified to be $Si_5Al_2O_{13}$. The specific surface area of the metallic oxide fine particles was measured by a specific surface area measuring instrument (MS-12; made by Quanta Chrome K.K.), and work function measurement was made by using a contact potential difference meter (SSVII-10; made by Kawaguchi Denki K. K.). Measurement results are summarized in Table 2. The metallic oxide fine particles were added in the quantity of 0.8 parts by weight relative to 100 parts by weight of the toner particles, and the mixture was agitated in a mixer for 2 minutes. A developing agent was thus obtained.

Experimental Data 2

Metallic oxide fine particles having a nominal composition weight ratio of $SiO_2/TiO_3$=70/30, obtained from Kojyundo Kagaku Kenkyusho K. K., were subjected to an elemental analysis through a fluorescent X-ray analysis. The composition ratio was identified to be $Si_{41}Ti_{10}O_{102}$. Measurement of the specific surface area and work function of the metallic oxide fine particles was carried out in the same way as in Experimental Data 1. Measurement results are shown in Table 2. The subsequent step was carried out in the same way as in Experimental Data 1, and thus a developing agent was obtained.

Experimental Data 3

Metallic oxide fine particles having a nominal composition weight ratio of $SiO_2/B_2O_3$=95/51 obtained from Kojyundo Kagaku Kenkyusho K. K., were subjected to an elemental analysis through a fluorescent X-ray analysis. The composition ratio was identified to be $Si_{68}B_{10}O_{151}$. Measurement of the specific surface area and work function of the metallic oxide fine particles was made in the same way as in Experimental Data 1, and measurement results are shown in Table 2. The subsequent step was carried out in the same way as in Experimental Data 1, and a developing agent was thus obtained.

Experimental Data 4

To 100 parts by weight of toner particles were added 0.8 parts by weight of same metallic oxide fine particles as used in Experimental Data 1, together with 0.1 part by weight of a hydrophobic silica (R-974; made by Nippon Aerosil; work function: 4.89, specific surface area: 179 $m^2/g$), and the mixture was stirred in a mixer for 2 minutes. A developing agent was thus obtained. The specific surface area and work function of the metallic oxide fine particles were measured in the same way as in Experimental Data 1. Measurement results are shown in Table 2.

Experimental Data 5

To 100 parts by weight of aforesaid toner particles were added 0.8 parts by weight of a hydrophobic silica (RA200H; made by Nippon Aerosil K.K.), and stirring was carried out in a mixer for 2 minutes. Thus, a developing agent was obtained. The specific surface area and work function of the inorganic fine particles were measured in the same way as in Experimental Data 1. Measurement results are shown in Table 2.

Experimental Data 6

To 100 parts by weight of the toner particles were added 0.6 parts by weight of a hydrophobic silica (R-974; made by Nippon Aerosil K.K. and 0.2 parts by weight of alumina fine particles (RX-C; made by Nippon Aerosil K.K.) and stirring was carried out in a mixer for 2 minutes. A development agent was thus obtained. The specific surface area and work function measurement of the inorganic fine particle mixture (weight ratio: $SiO_2/Al_2O_3$=3/1) was made in the same way as in Experimental Data 1. Measurement results are shown in Table 2.

TABLE 2

| Experimental Date | Weight Ratio $SiO_2$ | Other Metallic Oxide | x/y | Composition Formula | Specific Surface Area ($m^2/g$) | Work Function |
|---|---|---|---|---|---|---|
| 1 | 70% | ($Al_2O_3$) 24% | 2.5 | $Si_5Al_2O_{13}$ | 45 | 4.19 |
| 2 | 68% | ($TiO_2$) 22% | 4.1 | $Si_{41}Ti_{10}O_{102}$ | 43 | 4.62 |

TABLE 2-continued

| Experimental Date | Weight Ratio $SiO_2$ | Other Metallic Oxide | x/y | Composition Formula | Specific Surface Area ($m^2/g$) | Work Function |
|---|---|---|---|---|---|---|
| 3 | 82% | ($B_2O_3$) 7% | 6.8 | $Si_{68}B_{10}O_{151}$ | 99 | 4.62 |
| 4* | 70% | ($Al_2O_3$) 24% | 2.5 | $Si_5Al_2O_{13}$ | 45 | 4.19 |
| 5 | ≦99% | — | ≦100 | — | 165 | 4.01 |
| 6** | 75% | ($Al_2O_3$) 25% | — | — | 152 | 4.16 |

*In Experimental Data 4, hydrophobic silica (R-974) was externally added.
**In Experimental Data 6, hydrophobic silica (R-974) and alumina fine particles (RX-C) were externally added.

The developing agent obtained as above described and a carrier obtained as will be describer hereinafter were mixed in the ratio of developing agent/carrier=5/95, and thus a two component developing agent was prepared. The so prepared developing agent was put into an copying machine EP470Z (made by Minolta K. K.), and an endurance test of 10,000 sheets was carried out at 23° C. and 45% RH by using a chart of B/W ratio 6%. Measurement of charge quantity, and visual ranking with respect to toner fogging on the ground were made before and after the endurance test. Ranking was made according to the following criteria; x indicates that the toner is unacceptable for actual use; Δ or higher is acceptable for actual use; O is preferable; and ◎ is more preferable. Evaluation and measurement results are shown in Table 3.

Fogging:

◎: Fogging did not appear in the images at all;

O: There appeared almost no fogging in the images;

Δ: Slight fogging appeared in the images, but involves no problem for practical use; and x: Fogging appeared in the images and was found unacceptable for practical use.

Charge Quantity Measurement:

Measurement was made by means of the blow-off method.

TABLE 3

| Experimental Data | Before Endurance Test: Quantity of Charge (μc/g) | Before Endurance Test: Fogs on on the ground | After Endurance Test: Quantity of Charge (μc/g) | After Endurance Test: Fogs on the ground |
|---|---|---|---|---|
| 1 | 21.4 | ◎ | 19.9 | ○ |
| 2 | 18.3 | ○ | 17.1 | Δ |
| 3 | 18.2 | ○ | 16.8 | Δ |
| 4 | 21.6 | ◎ | 20.4 | ◎ |
| 5 | 18.3 | ○ | 11.2 | x |
| 6 | 18.5 | ○ | 13.9 | x |

Carrier Preparation

One hundred parts by weight of polyester resin (NE-1110; made by Kao K. K.), 500 parts by weight of inorganic magnetic particles (EPT-1000; made by Toda Kogyo K. K.), and 2 parts by weight of carbon black (MA#8; made by Mitsubishi Kagaku K. K.) were thoroughly crushed and mixed in a Henschell mixer. The obtained mixture was melted and kneaded by using an extruder-kneader. The kneaded mixture was then cooled and pulverized into coarse particles. Then, the particles were pulverized in a jet mill, and the pulverized particles were air-classified by an air classifier. Thus, a binder-type magnetic carrier having a mean particle size of 55 μm was obtained.

Experimental Data 7

Metallic oxide fine particles having a nominal composition weight ratio of $SiO_2/Al_2O_3$=70/30, obtained from Kojyundo Kagaku Kenkyusho K. K., were subjected to an elemental analysis through a fluorescent X-ray analysis. The composition ratio was identified to be $Si_5Al_2O_{13}$. The work function of the metallic oxide fine particles was measured by using a contact potentiometer (SSVII-10; made by Kawaguchi Denki K. K.). Measurement results are summarized in Table 4.

A mixture solution containing 2 g of hexamethyldisilazine dissolved in 10 g of tetrahydrofuran was prepared. On the other hand, the above metallic oxide fine particles were treated at 120° C. for 2 hours. Thirty five grams of the metallic oxide fine particles was put into a high-speed mixer. While the fine particles were stirred at 2500 rpm, the above mixture solution was gradually added for minutes. Further, 5 g of the fine particles was added, and stirring was carried out at 3000 rpm for 10 minutes. Thereafter, the mixture was heat-treated in a constant temperature bath at 150° C. for 2 hours. Thereafter, the mixture was disintegrated and thus surface modified metallic oxide fine particles were obtained. The specific surface area of the metallic oxide fine particles obtained in this way was measured by a specific surface measuring instrument (MS-12; made by Quanta Chrome K.K.), and the work function of the particles was again measured by a contact potentiometer (SSVII-10; made by Kawaguchi Denki K. K.). The measurement of hydrophobicity was made in manner as will be hereinafter described. Measurement results are summarized in Table 4.

Metallic oxide fine particles (0.8 parts by weight) was added to 100 parts by weight of the toner particles. The resultant mixture was stirred in a mixer for 2 minutes. Thus, a developing agent was obtained.

Experimental Data 8

Metallic oxide fine particles having a nominal composition weight ratio of $SiO_2/TiO_3$=70/30, obtained from Kojyundo Kagaku Kenkyusho K. K., were subjected to an elemental analysis through a fluorescent X-ray analysis. The composition ratio was identified to be $Si_{41}Ti_{10}O_{102}$. A developing agent was obtained in the same way as in. Experimental Data 7 except that the metallic oxide fine particles were used. Measurement of the specific surface. area, work function, and hydrophobicity of the metallic oxide fine particles was carried out in the same way as in Experimental Data 7. Measurement results are shown in Table 4.

Experimental Data 9

Metallic oxide fine particles having a nominal composition weight ratio of $SiO_2/B_2O_3$=95/5, obtained from Kojyundo Kagaku Kenkyusho K. K., were subjected to an elemental analysis through a fluorescent X-ray analysis. The composition ratio was identified to be $Si_{68}B_{10}O_{151}$. A developing agent was obtained in the same way as in Experimental Data 7 except that the metallic oxide fine particles were used. Measurement of the specific surface area, work function, and hydrophobicity of the metallic oxide fine particles were carried out in the same way as in Experimental Data 7. Measurement results are shown in Table 4.

Experimental Data 10

To 100 parts by weight of toner particles were added 0.8 parts by weight of same hydrophobic metallic oxide fine particles as used in Experimental Data 7, together with 0.1 part by weight of a hydrophobic silica (R-974; made by Nippon Aerosil; work function: 4.89, hydrophobicity: 35%, and specific surface area: 179 $m^2/g$), and the mixture was stirred in a mixer for 2 minutes. A developing agent was thus obtained. The specific surface area, work function, and hydrophobicity of the metallic oxide fine particles were measured in the same way as in Experimental Data 7. Measurement results are shown in Table 4.

Experimental Data 11

To 100 parts by weight of aforesaid toner particles were added 0.8 parts by weight of a hydrophobic silica (RA200H; made by Nippon Aerosil K.K.), and stirring was carried out in a mixer for 2 minutes. Thus, a developing agent was obtained. The specific surface area, work function, and hydrophobicity of the inorganic fine particles were measured in the same way as in Experimental Data 7. Measurement results are shown in Table 4.

Experimental Data 12

A developing agent was obtained in the same way as in Experimental Data 7 except that the quantity of hexamethyl disilazane was 1 g. Measurement of the specific surface area, work function, and hydrophobicity of the metallic oxide fine particles were carried out in the same way as in Experimental Data 7. Measurement results are shown in Table 4.

TABLE 4

| Experimental Data | Weight Ratio $SiO_2$ | Other Metallic Oxide | x/y | Composition Formula | Specific Surface Area ($m^2/g$) | Work Function Before Treatment | Work Function After Treatment | Hydrophobicity (%) |
|---|---|---|---|---|---|---|---|---|
| 7 | 70% | ($Al_2O_3$) 24% | 2.5 | $Si_5Al_2O_{13}$ | 41 | 4.19 | 4.03 | 48 |
| 8 | 68% | ($TiO_2$) 22% | 4.1 | $Si_{41}Ti_{10}O_{102}$ | 45 | 4.62 | 4.13 | 42 |
| 9 | 82% | ($B_2O_3$) 7% | 6.8 | $Si_{68}B_{10}O_{151}$ | 86 | 4.62 | 4.12 | 34 |
| 10 | 70% | ($Al_2O_3$) 24% | 2.5 | $Si_5Al_2O_{13}$ | 41 | 4.19 | 4.03 | 48 |
| 11 | ≦99% | — | ≦100 | — | 165 | 4.81 | 4.01 | 50 |
| 12 | 70% | ($Al_2O_3$) 24% | 2.5 | $Si_5Al_2O_{13}$ | 45 | 4.19 | 4.13 | 19 |

*In Experimental Data 10, hydrophobic silica (R-974) was externally added.

A two-component developing agent was prepared by mixing the developing agent obtained as above described and the carrier obtained as above described in the ratio of developing agent/carrier=5/95. Endurance tests were made with the developing agent in the same way as above described, and evaluation was made in the same way. Also, static charge measurement was made with respect to the developing agent after exposure to environmental conditions of 35° C. and 85% RH for 24 hours. Test results and evaluation are shown in Table 5.

TABLE 5

| | Before Endurance/ Environmental Stability Test | | After Endurance Test | | After Environmental |
|---|---|---|---|---|---|
| Experimental Data | Quantity of Charge (μc/g) | Fog on the ground | Quantity of Charge (μc/g) | Fog on the ground | Test Quantity of Charge (μc/g) |
| 7 | 22.3 | ◎ | 19.9 | ○ | 21.4 |
| 8 | 18.7 | ○ | 17.3 | Δ | 18.1 |
| 9 | 18.8 | ○ | 16.7 | Δ | 18.2 |
| 10 | 22.8 | ◎ | 20.6 | ○ | 21.7 |
| 11 | 18.3 | ○ | 11.2 | x | 17.4 |
| 12 | 21.7 | ◎ | 20 | ○ | 16.2 |

Measurement of Hydrophobicity

Deionized water (50 ml) was put into a 200 ml beaker and 0.2 g of sample was added. Methanol dehydrated with anhydrous sodium sulfate was added from a burette with stirring. The degree of hydrophobicity was calculated from the following relation based on the quantity of methanol (C (cc)) required until the sample almost disappeared from visual sight of the liquid level.

Hydrophobicity (%)=100 C/(50 +C)

What is claimed is:

1. A developing agent comprising:

toner particles containing at least a binder resin and a coloring agent; and metallic oxide fine particles represented by a composition formula $Si_xA_yO_{(4x+yz)/2}$, wherein the character A represents a metallic element selected from the group consisting of boron, titanium and vanadium, the character Z represents a valence number of A, and x/y is 1–25.

2. The developing agent according to claim 1, wherein the character A represents an element selected from is the group consisting of boron and titanium.

3. The developing agent according to claim 1, wherein the value x/y is 1–20.

4. The developing agent according to claim 1, wherein the value x/y is 1–10.

5. The developing agent according to claim 1, wherein the metallic oxide fine particles are externally added to the toner particles.

6. The developing agent according to claim 1, wherein a work function of the metallic oxide fine particles is 3.5 to 5.0 eV.

7. The developing agent according to claim 1, wherein a specific surface area of the metallic oxide fine particles is 10 to 400 $m^2/g$.

8. The developing agent according to claim 5, wherein inorganic fine particles having a mean primary particle size of not more than 20 nm are further added externally to the toner particles.

9. The developing agent according to claim 8, wherein a total addition of the inorganic fine particles and the metallic oxide particles is 0.01 to 5 parts by weight relative to 100 parts by weight of toner particles.

10. A developing agent comprising:

toner particles containing at least a binder resin and a coloring agent; and metallic oxide fine particles represented by a composition formula $Si_xA_yO_{(4x+yz)/2}$, wherein the character A represents a metallic element selected from the group consisting of boron, titanium and vanadium, the character Z represents a valence number of character A, and x/y is 1–25, wherein the metallic oxide fine particles are treated by a hydrophobicizing agent to have a hydrophobicity of not less than 30%.

11. The developing agent according to claim 10, wherein the difference between a work function of the metallic oxide fine particles before the hydrophobicizing treatment and that after the hydrophobicizing treatment is not more than 0.5.

12. The developing agent according to claim 11, wherein the work function of the metallic oxide fine particles before the hydrophobicizing treatment is 3.5 to 5.0 eV.

13. The developing agent according to claim 10, wherein the character A represents an element selected from the group consisting of boron and titanium.

14. The developing agent according to claim 10, wherein the value x/y is 1–20.

15. The developing agent according to claim 10, wherein the value x/y is 1–10.

16. The developing agent according to claim 10, wherein a specific surface area of the metallic oxide fine particles is 10 to 400 $m^2/g$.

17. The developing agent according to claim 10, wherein the metallic oxide fine particles are externally added to the toner particles.

18. The developing agent according to claim 17, wherein inorganic fine particles having a mean primary particle size of not more than 20 nm are further added externally to the toner particles.

19. The developing agent according to claim 18, wherein a total addition of the inorganic fine particles and the metallic oxide fine particles is 0.01 to 5 parts by weight relative to 100 parts by weight of the toner particles.

* * * * *